United States Patent [19]

Fisher et al.

[11] Patent Number: 4,494,102

[45] Date of Patent: Jan. 15, 1985

[54] TRANSFORMER CORE AND METHOD AND APPARATUS FOR FORMING SAME

[75] Inventors: John L. Fisher; Joe E. Curtis, Jr., both of Lexington, Ky.

[73] Assignee: Kuhlman Corporation, Troy, Mich.

[21] Appl. No.: 413,288

[22] Filed: Aug. 31, 1982

[51] Int. Cl.[3] ..... H01F 27/24

[52] U.S. Cl. ..... 336/212; 336/196; 336/198; 336/206; 336/209; 336/228

[58] Field of Search ..... 336/196, 198, 206, 209, 336/210, 212, 228

[56] References Cited

U.S. PATENT DOCUMENTS

| | | | |
|---|---|---|---|
| 714,891 | 12/1902 | Gill . | |
| 1,224,184 | 5/1917 | McConalley | 336/206 |
| 2,477,350 | 7/1949 | Somerville | 29/602 |
| 2,478,029 | 8/1949 | Vienneau | 336/210 |
| 2,646,535 | 7/1953 | Coggeshall et al. | 336/206 X |
| 2,878,855 | 3/1959 | Gakle et al. . | |
| 3,200,357 | 8/1965 | Olsen et al. | 336/206 X |
| 3,247,476 | 4/1966 | Pintell | 336/206 X |
| 3,252,118 | 5/1966 | Hughes | 336/213 |
| 3,466,744 | 9/1969 | Hughes | 24/606 |

*Primary Examiner*—A. D. Pellinen
*Assistant Examiner*—Susan A. Steward
*Attorney, Agent, or Firm*—Harness, Dickey & Pierce

[57] ABSTRACT

An improved magnetic core for an electrical transformer, and a method and apparatus for forming the core, are disclosed wherein the corners of core windows are configured to decrease the magnetic path length, thereby reducing the core losses and the amount of material necessary to construct the core. One exemplary embodiment includes a core window opening having an outer corner radii that are larger than the inner corner radii. Alternatively, the core window may have corners of a non-constant radii, with the outer corners having a more gradual or gentle curvature. These and other disclosed embodiments also enhance the ease of assembly of the transformer core and thus decrease or eliminate damage to the magnetic material during assembly.

26 Claims, 16 Drawing Figures

TRANSFORMER CORE AND METHOD AND APPARATUS FOR FORMING SAME

BACKGROUND AND SUMMARY OF THE INVENTION

The invention relates generally to electrical devices having magnetic cores, and more particularly to electrical transformers.

One typical example of an electrical transformer includes one or more convolutely or concentrically wound magnetic cores. In this type of transformer, the magnetic core may be formed from a number of radially adjacent lamination strips of magnetic material. The strips may be cut to precise lengths, which are incrementally adjusted to compensate for the radial build of the core, assembled into a circular configuration and then pressed into a generally rectangular or quadrilateral shape having a window opening extending axially therethrough.

Each circular laminated core is pre-shaped to a final generally rectangular or other quadrilateral configuration, restrained in this shape, and then annealed to relieve internal mechanical stresses resulting from the shaping process. After shaping and annealing, the core or cores are assembled or "laced" through a pre-wound coil assembly which includes both high voltage and low voltage windings. The lacing procedure involves removing the innermost group of laminations from the annealed core structures and inserting the cut ends of the laminations through the opening in the coil assembly. This process is repeated with intermediate groups of laminations until the outermost laminations have been laced into the coil assembly. Thus, in the finished coil and core structure, the high and low voltage windings extend through the window openings in the magnetic cores, and the cores extend through a window opening in the coil assembly.

In another type of transformer, each of one or more magnetic cores is comprised of a series of axially stacked laminations. In such a configuration each lamination may be stamped or die-cut in a one-piece or multi-piece configuration having a generally rectangular or other quadrilateral shape, with a window opening extending therethrough. The laminations are serially stacked in an axially adjacent arrangement, through the window opening of one or more coil assemblies.

Although electrical transformers of the types described above have proved to be quite reliable and efficient, the present invention provides for a significant improvement in the performance characteristics of such transformers by decreasing both the losses through the core and the amount of material needed to fabricate the core. The window opening extending through a core constructed in accordance with the invention has a corner at the intersections between the outer leg portion and the upper and lower yoke portions that is more gradually curved than the corner at the intersections between the inner leg portion and the upper and lower yoke portions. Such a configuration significantly improves the space utilization factor of the transformer core window, thereby shortening the magnetic path length and decreasing the amount of magnetic material required to fabricate the core. The more gradually curved outer window corners also contribute to the ease of lacing the core laminations into the coil assembly by making it easier to align the serially inserted groups of laminations. Such ease of insertion into the coil assembly therefore reduces the mechanical stresses placed upon the previously annealed core during assembly. Such ease of assembly reduces the amount of mechanical strain (and the resultant increased losses, termed "destruction") suffered by the magnetic core material during assembly, thereby increasing the efficiency and performance of the transformer. Alternatively, both the inner and outer window corners may be gradually curved if resilient or extensible insulating materials and winding from materials are used, for example.

According to a preferred method and apparatus for manufacturing or forming the magnetic core according to the invention, a quantity of magnetic material is formed into a generally toroidal configuration. At least one forming member, and preferably an assembly of a pair of said forming members, are inserted into the opening extending through the toroid of magnetic material. The forming members have first and second forming surfaces that are separated by window corner-forming surfaces of a predetermined shape for forming the desired window corner shape and configuration as described above.

First portions of the magnetic are material forcibly deformed against the first forming surfaces of the forming members, preferably by compressing the first portion between the forming members and corresponding first forming die plates located on opposite sides of the toroidally-shaped magnetic material. Similarly, second portions of the magnetic material are preferably deformed by being compressed between the second forming surfaces and corresponding second die plates on opposite sides of the toroidal magnetic material. During the deforming of second portions the magnetic material is urged against the window corner-forming surfaces to form the window corners with great precision to the predetermined and desired configuration.

The forming members, in the preferred embodiment, are generally U-shaped or channel-shaped end plugs. The base of each end plug has the first forming surface on its exterior, and the spaced legs of the end plug have the second forming surfaces on their exteriors, with the corner-forming surfaces therebetween. Preferably, a pair of first force-applying mechanisms, which may be hydraulic or pneumatic cylinders, for example, are equipped with forcibly extendible members for urging the first die plates against the magnetic material. The first force-applying mechanisms also include anchoring structures for holding the end plugs in place at a fixed position relative to the force-applying mechanisms when the first portion of the magnetic material is compressed. When the second portions of the magnetic material are deformed, the preferred first force-applying mechanisms and the end plugs slidably move apart and spacer members are inserted between the end plugs to preserve the desired core shape until after the core is annealed.

Additional advantages and features, as well as additional embodiments and variations, of the present invention will become apparent from the subsequent description and the appended claims taken in conjunction with the accompanying drawings.

BRIEF DESCRIPTION OF THE DRAWINGS

FIG. 6 is an enlarged detail view similar to that of FIGS. 3 and 5, but illustrating still another alternate core configuration.

DETAILED DESCRIPTION OF THE PREFERRED EMBODIMENTS

Figure 1:
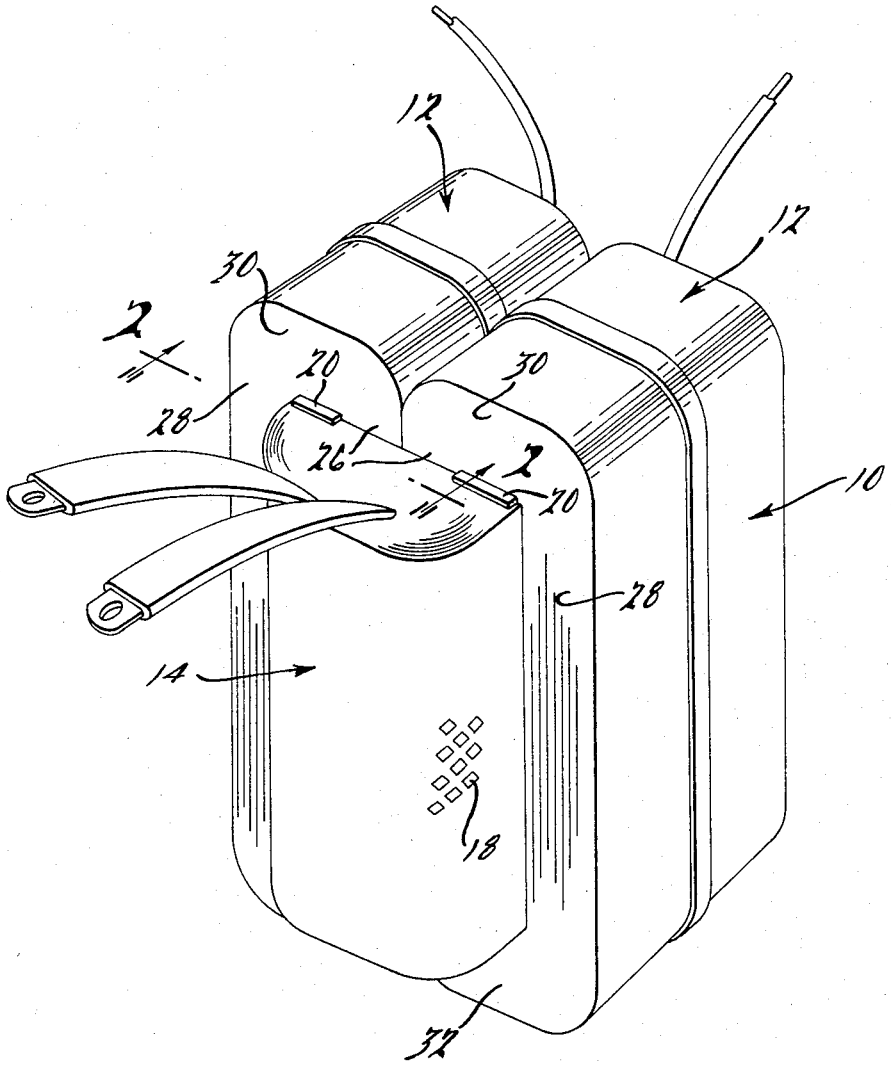
FIG. 1 is a perspective view of the coil and core assembly of an exemplary electrical transformer embodying the present invention.

FIGS. 1 through 16 of the drawings depict exemplary embodiments of the present invention for purposes of illustration only. One skilled in the art will readily recognize from the following discussion that the principles of the invention are equally applicable to other electrical devices employing magnetic cores and to electrical transformers of other types and configurations than that shown in the drawings.

Figure 2:
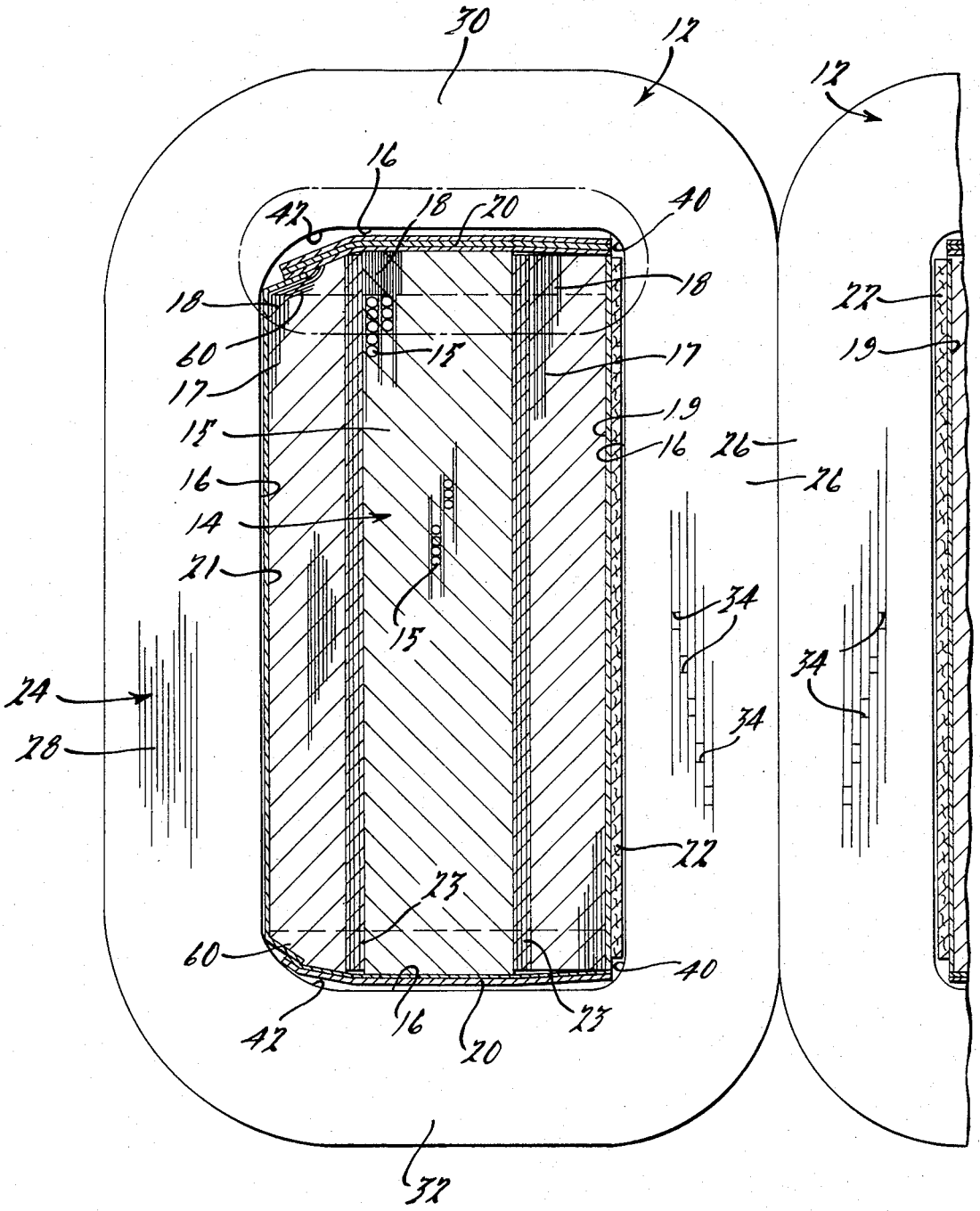
FIG. 2 is a cross-sectional view taken along line 2—2 of FIG. 1, with the core and the coil assembly illustrated schematically.

In FIGS. 1 and 2, the core and coil assembly 10 of an exemplary "shell-type" electrical distribution transformer generally includes a pair of magnetic cores 12 and a coil assembly 14. The coil assembly 14 includes both high voltage windings 15 and low voltage windings 17 which extend through the window opening 16 in each of the magnetic cores 12. The high voltage and low voltage windings of the coil assembly 14 are wound or wrapped with interleaved insulating paper 18 and inner and outer insulating paper wraps 19 and 21, respectively, around a heavy pressborad winding form 22. The insulating paper 18 extends axially beyond the windings to form a so-called "keep-back" distance between the interior surface of the core window openings 16 and the windings 15 and 17. The insulating paper 18, yoke insulation members 20 (shown are two of their various alternate forms in the drawings), and high-low barriers 23 serve to withstand dielectric stresses resulting from voltage distributions to which the transformer windings will be subjected, including both normal operating voltage stresses and those encountered during high voltage impulses caused, for example, by lightning.

As shown in FIG. 2, each magnetic core 12 of the exemplary transformer is composed of a plurality of incrementally cut strips of magnetic material 24 wound or otherwise disposed in a generally concentric or convolute configuration and formed into a generally rectangular or other quadrilateral shape. The laminations of magnetic material 24 form spaced-apart inner and outer leg portions 26 and 28, respectively, which are interconnected by a pair of spaced-apart upper and lower yoke portions 30 and 32, respectively. It should be understood that the description of yoke portions 30 and 32 as being "upper" and "lower", respectively, merely refers to the orientation of the magnetic cores shown in the drawings for purposes of illustration only.

In order to facilitate the lacing of the magnetic cores 12 into the coil assembly 14, substantially all of the joints 34 of the cut ends of the strips of magnetic material 24 are preferably positioned to lie in the inner leg portion 26. Such joints may, however, be positioned in either the upper or lower yoke portions or distributed around the core perimeter. In still another variation, two cuts may be provided, one completely through each leg, thus forming two "C-shaped" half-cores, the laminations of which have been previously bonded together. The cut ends of the bonded laminations are typically polished to achieve a minimum air gap when the half-cores are fitted through the coil assembly opening from opposite ends into a mating relationship. Additionally, the laminations of magnetic material may be cut at intervals to form strips having a length either greater than or less than one turn around the core, and either with or without lamination bonding.

Figure 3:
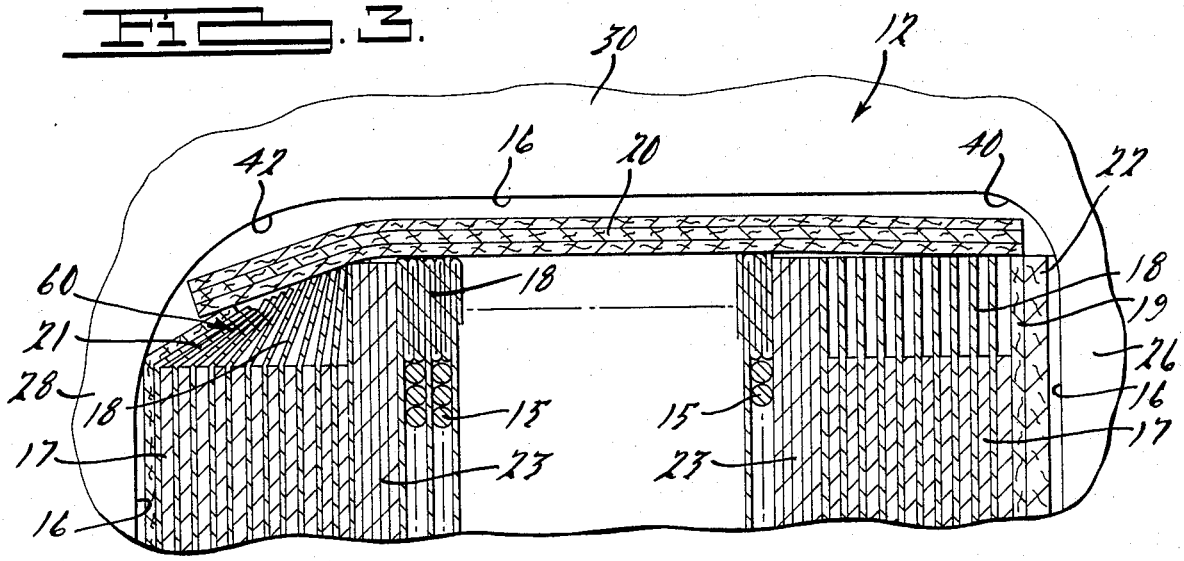
FIG. 3 is an enlarged detail view of the core and coil interface portion of FIG. 2.

Referring to FIGS. 2 and 3, the preferred magnetic core 12 is formed and annealed, as described below, with a window opening 16 having radiused window corners 40 at the intersections between the inner leg portion 26 and the upper and lower yoke portions 30 and 32. Similarly, the window opening 16 is formed with radiused outer window corners 42 at the intersections of the outer leg portion 28 and the upper and lower yoke portions. The radii of the outer corners 42 are larger than the radii of the inner corners 40 in order to decrease the magnetic path length and the amount of magnetic material needed to form the magnetic core 12.

The radii of the outer corners 42 may be made larger than the radii of the inner corners 40 because of the ability of the outer insulating paper 21 and the interleaved insulating paper 18 at the outer axial ends of the coil assembly 14 to be deflected or folded inward toward the interior of coil assembly, as indicated generally in FIG. 2 by reference numeral 60. In contrast, the size of the radius of the inner corners 40 is limited by the typical inability of both the inner insulating paper wrap 19 and the insulating paper 18 at the inner axial edges of the coil ends and the winding form 22 to be deflected outward toward the exterior of the coil assembly without being torn or otherwise damaged or destroyed. Therefore, by forming the magnetic core with its outer corner radii greater than its inner corner radii, the magnetic path length and the amount of material necessary to construct the core is reduced to the extent practicable. Such reduction thereby decreases the core excitation losses when the transformer is in an energized state and thus increases the efficiency of the transformer. As a result, the core construction of the present invention provides substantial economic savings in terms of materials used in the fabrication of the transformer and reduces the continuous excitation energy requirements of the electrical distribution system in which the transformer is installed.

Preferably, the ratio of the radii of the outer corners 42 to the radii of the inner corners 40 is in the range of approximately five-to-one to approximately two-to-one. It has been found in magnetic cores actually constructed in accordance with the principles of the invention that a ratio of outer corner radius to inner corner radius of approximately three-to-one, with an outer corner radius of approximately 0.75 inch and an inner corner radius of approximately 0.25 inch, yields a magnetic core with excellent performance characteristics. The exact corner radius sizes and ratios necessary to derive the maximum benefits of the invention, however, depend upon various parameters of the electrical transformer in a given application. Examples of such parameters, which are known to those skilled in the art, include the type of transformer construction (e.g., core-type or shell-type), the size and electrical rating of the transformer, the keep-back distance from the edges of the insulating paper to the windings, the yoke insulation construction, and the types of materials used in the various components of the transformer.

Figure 5:
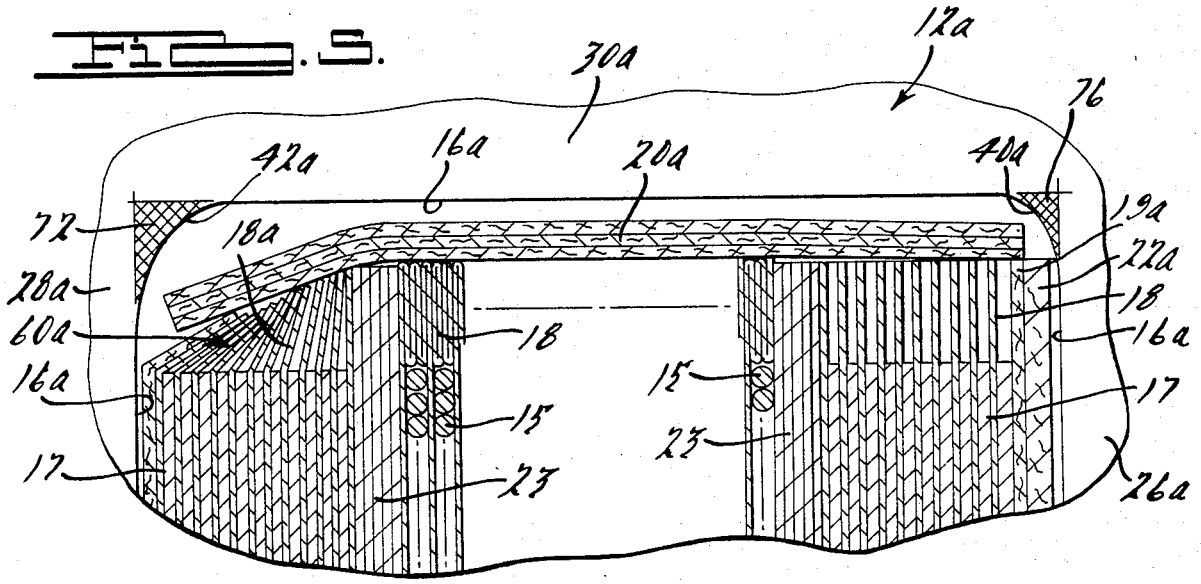
FIG. 5 is an enlarged detail view similar to that of FIG. 3, but illustrating the alternate core configuration of FIG. 4.
Figure 4:
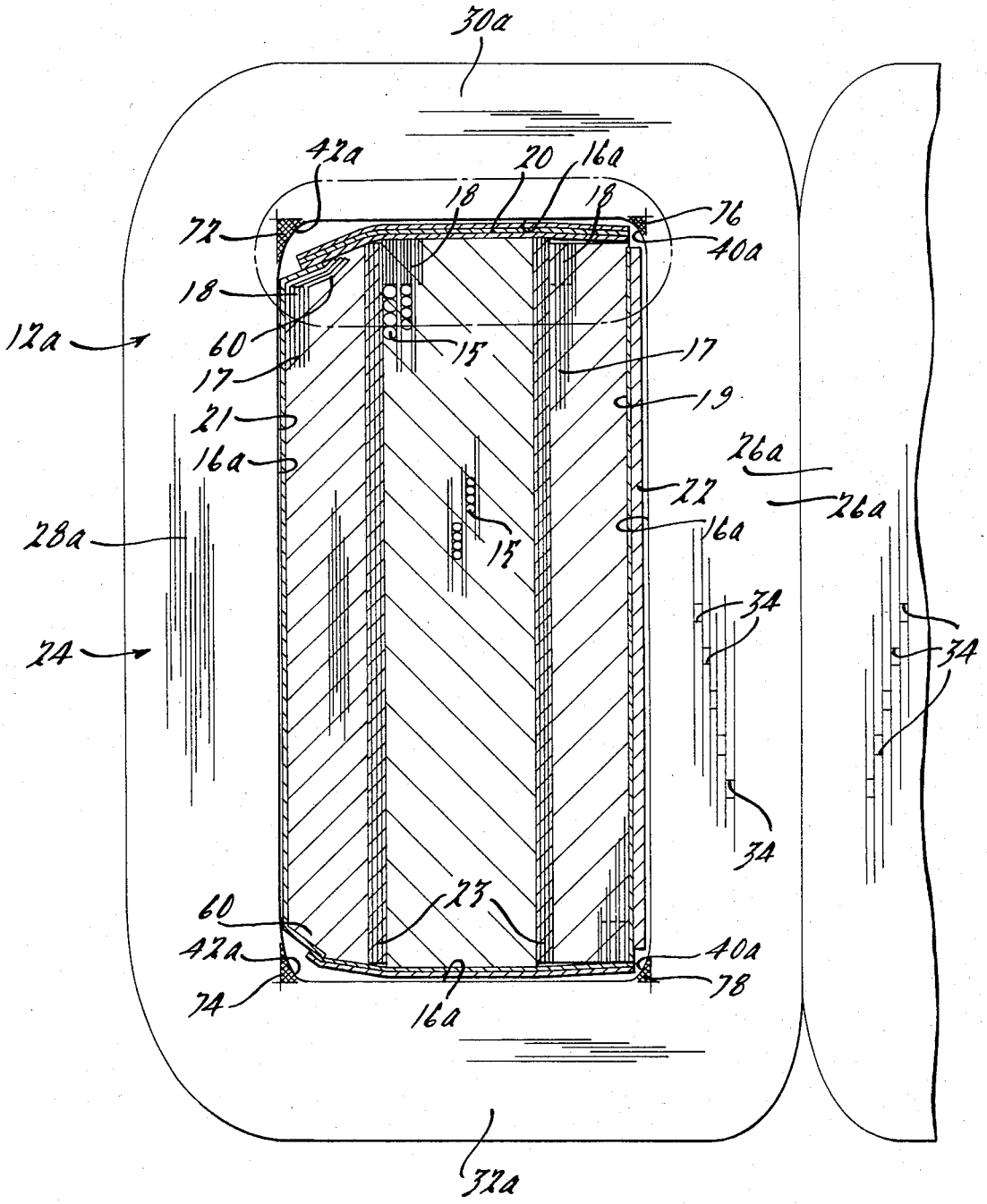
FIG. 4 is a view similar to that of FIG. 2, illustrating an alternate magnetic core configuration.

One skilled in the art will readily recognize that any of the corners of the window opening 16 may alternatively be formed with either a regular or an irregular corner curvature and may be shaped so as to form an arcuate corner having either a constant radius, as shown in FIGS. 2 and 3, or a radius that varies within a particular arcuate corner as shown in FIGS. 4 and 5. In FIGS. 4 and 5, the projections or extensions of the inner edges of the leg portions 26*a* and 28*a* and the inner edges of the yoke portions 30*a* and 32*a*, along with the corners 40*a* and 42*a* of the core window opening 16*a*, define a pair of outer excluded areas 72 and 74 and a pair of inner excluded areas 76 and 78. In order to achieve the benefits of the invention, the window opening corners may be formed such that the outer excluded areas 72 and 74 are larger than the inner excluded areas 76 and 78. Such relationship between the outer and inner excluded areas may be used to provide outer corners having a more gradual or gentle curvature than that of the inner corners, whether the corners are formed with constant or varying corner radii or even with regular or irregular corner curvatures. Preferably, the ratio of the outer excluded areas to the inner excluded areas is the range of approximately twenty-five-to-one to approximately four-to-one. It has been found that a core window with a ratio of outer excluded areas to inner excluded areas of approximately nine-to-one yields a magnetic core with excellent performance characteristics. However, as is discussed above in connection with the constant corner radius corners shown in FIGS. 2 and 3, the exact excluded area ratios depend on various transformer parameters that are well-known to those skilled in the art.

One skilled in the art will also recognize from the foregoing discussion that the radii or curvatures of the outer window opening corners need not be equal to each other and, similarly, that the radii or curvatures of the inner window opening corners need not be equal to each other. Thus, in order to form a magnetic core that is most ideally suited for its intended application in a transformer or other induction device, the curvature of any of the window opening corners may be different from one or more of the other corners of the window opening.

The exemplary embodiments of the magnetic cores illustrated in FIGS. 2 through 5 include window openings having outer corner curvatures that are greater or more gentle than the inner corner curvatures. This is because of the typical inability of the inner insulating paper and the winding form to be deflected or folded outwardly as discussed above. If, however, inner insulation and winding form material is used that is composed of a relatively resilient or extensible material, the principles of the present invention may be employed to provide a magnetic core having a more gradual or gentle curvature on both the inner and outer window opening corners such as is illustrated in FIG. 6. In the fragmented view of FIG. 6, an alternate magnetic core 12*b* includes inner and outer leg portions 26*b* and 28*b*, respectively, and upper and lower yoke portions 30*b* and 32*b* (not shown), respectively. The window opening 16*b* is formed with inner corners 40*b* and outer corners 42*b* having a very gradual or gentle curvature such that the keep-back distance increases in an inward direction from the intersection of the outer leg portion 28*b* to a location or position lying between the inner and outer leg portions 26*b* and 28*b*. Similarly, the keep-back distance decreases in an inward direction from a location between the leg portions to the intersection of the inner leg portion 26*b* and the yoke portion. In the exemplary embodiment shown in FIG. 6, the keep-back distance is greatest at a mid-way location between the leg portions corresponding with the position of the high-voltage coil windings 15. A multiple layer yoke insulation member 20*b*, for example, is disposed between the coil winding ends and each yoke portion.

Such gradual curvature in the inner window opening corners is possible if the inner insulating material 18*c* is composed of a resilient or extensible material such as, for example, crepe paper, vinyl compositions or other suitable materials that are known to those skilled in the art. Such materials provide the capability of the insulation material 18*c* to be folded or deflected outwardly as indicated by reference numeral 60*c*. The winding form 22*b*, as shown in FIG. 6, is axially shorter than the corresponding winding forms 22 and 22*a* illustrated in the previously discussed embodiments. Thus, because the shortened winding form 22*b* does not interfere with the curvature of corner 40*b*, it does not need to be capable of folding or deflecting outwardly. Alternatively, however, the winding form may be axially longer but composed of resilient or extensible materials such as those mentioned above so that it can be folded or deflected outwardly to accommodate the gradual curvature of corner 40*b*.

One skilled in the art will readily recognize that the embodiment of FIG. 6 may of course be modified. In one example of such a modification, a radius extending less than 90° at the intersections may be provided between the leg and yoke portions, with either a generally straight or curved edge (or other configuration) extending toward the intermediate location where the keep-back distance is maximized. It should also be pointed out that like those of the other embodiments, the principles of the exemplary embodiment of FIG. 6 are applicable to magnetic cores wherein the corner configurations are different at some or all of the window opening corners.

Figure 7:
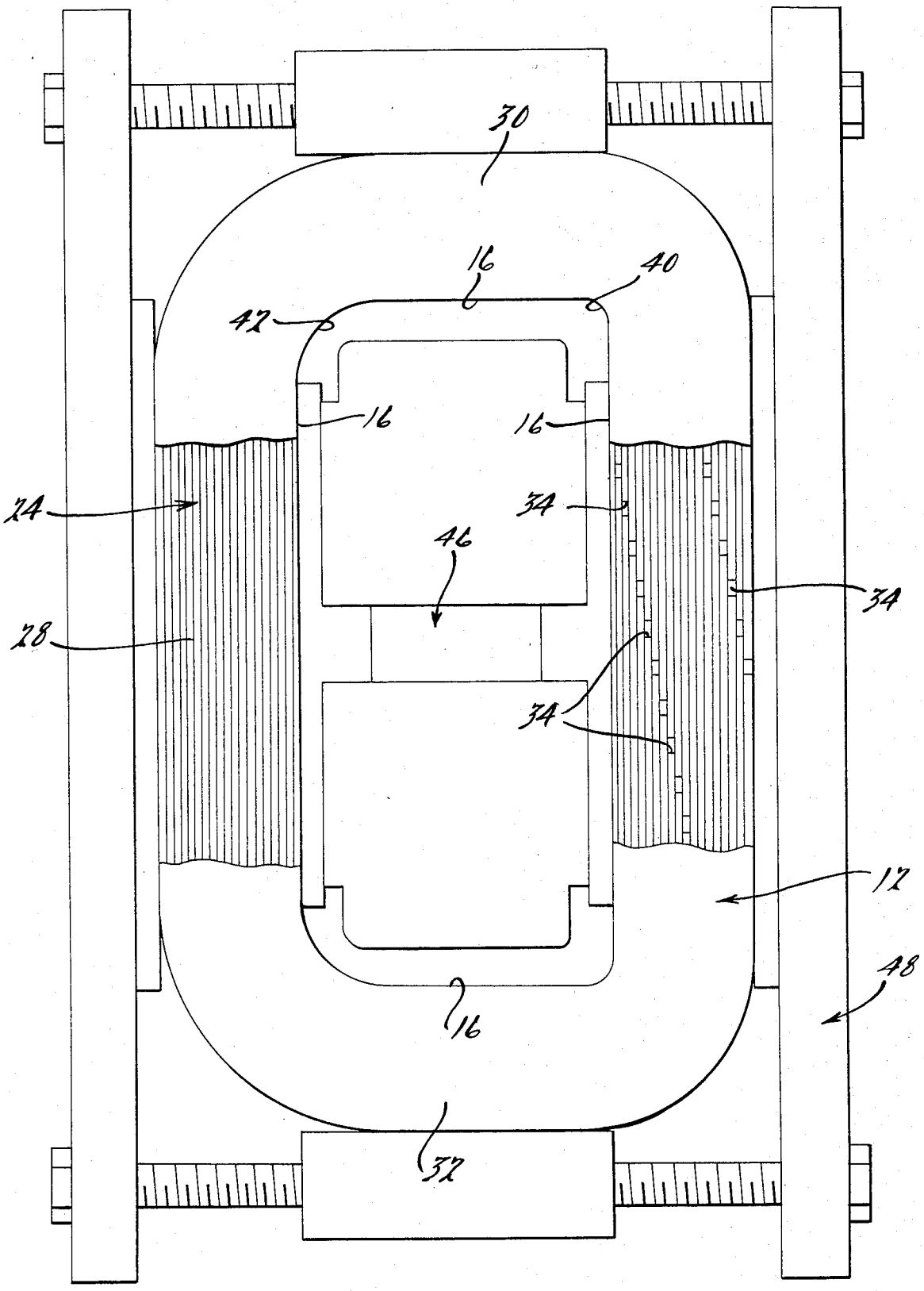
FIG. 7 illustrates the magnetic core of FIGS. 2 and 3, shown with apparatus for forming the magnetic core to its rectangular shape or quadrilateral shape.
Figure 8:
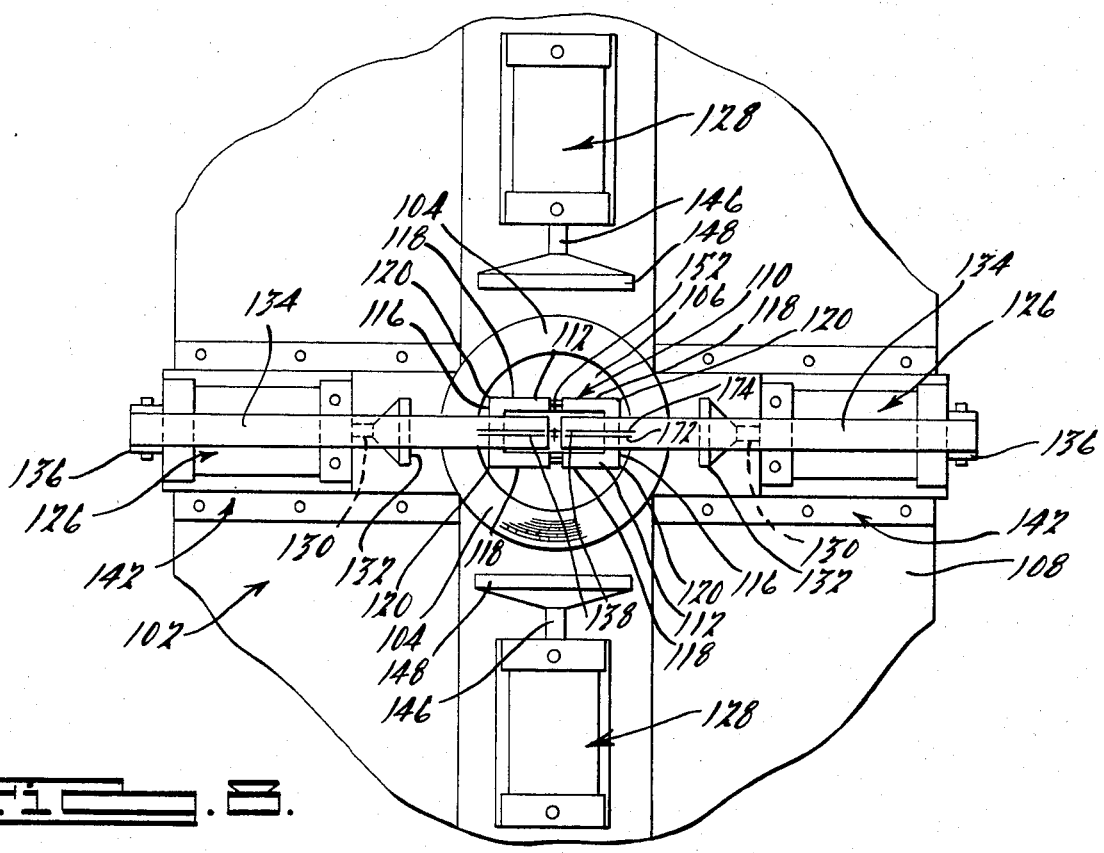

As shown in FIG. 7, in connection with the magnetic core 12 of FIGS. 2 and 3 for purposes of illustration only, when any of magnetic cores of the invention are formed, the wound magnetic material 24 may be pressed or otherwise urged, as is described below, into the desired configuration around a forming assembly, such as the representative forming plug assembly 46 shown schematically in FIG. 7, in order to form and shape the window opening 16. An external retention apparatus 48 may be placed around the periphery of the magnetic core to maintain its shape during annealing. The internal forming plug assembly 46 is machined or otherwise formed with corners corresponding to the desired shape and configuration of the window opening corners at the intersections between the inner and outer leg portions and the upper and lower yoke portions in a relatively precise manner in order to preserve the desired core shape until the internal mechanical stresses resulting from the shaping process are removed by stress relief annealing. The method and apparatus for forming the magnetic core are illustrated in FIGS. 8 through 16 and described below.

Figure 8:
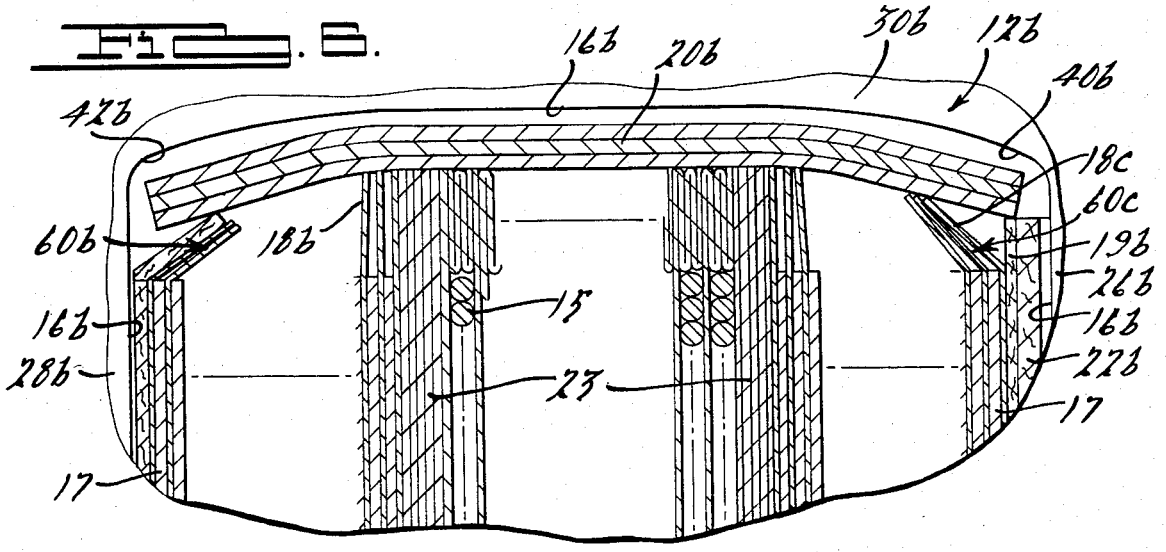
FIG. 8 is a plan view of the preferred apparatus for forming a magnetic core according to the present invention, illustrating said apparatus at the beginning of the forming operation.

FIGS. 8 through 11 illustrate a preferred method and apparatus for forming any of the above-described embodiments of a magnetic core according to the present invention. In FIG. 8, a preferred forming apparatus 102 is shown with generally toroidal-shaped quantity of magnetic material 104 prior to the operations involved in forming the magnetic core. The magnetic material 104 is placed upon a platform 108 with its axially-extending central opening 106 oriented generally perpendicular to the platform.

Figure 11:
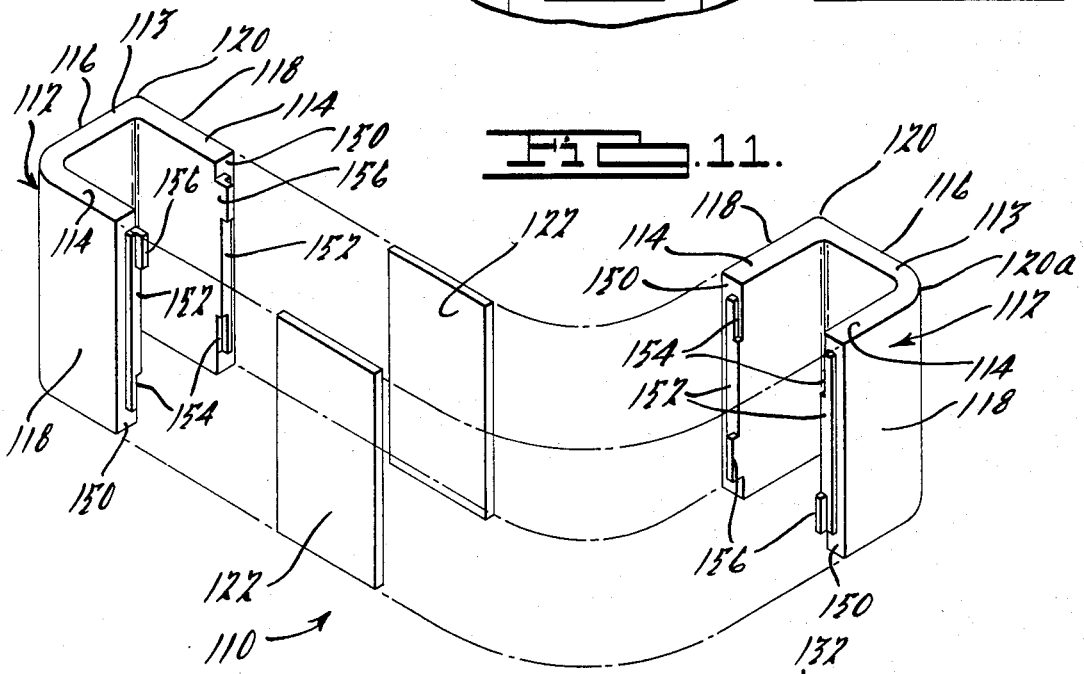
FIG. 11 is an exploded perspective view of a preferred assembly for forming the window and window corners of a magnetic core according to the present invention.

A forming assembly 110, which is shown in detail in FIG. 11, is inserted into the central opening 106 prior to the forming operations for purposes of forming the window opening of the core to a predetermined shape with a very high degree of precision. Such high degree of precision has a major contribution to the capability of forming the core window opening with the predetermined corner shapes and configurations discussed above. If the core is the type described above having adjacent cut strips of magnetic material, the toroidally-shaped magnetic material must be properly oriented relative to the forming assembly 110 so that the cut ends will be positioned in the desired portion of the formed core.

As shown in FIG. 11, the forming assembly 110 preferably includes a pair of end plugs or end forming members 112 having a generally U-shaped configuration in cross-section. Each of the forming members 112 includes a base portion 113 with a pair of spaced-apart leg portions 114 protruding outwardly from the base portion to their outer ends 150. In the preferred arrangement, the base portion 113 has a core yoke-forming surface 116 on its exterior, and the leg portions 114 each have a core leg-forming surface 118 on their exterior sides. A pair of window corner-forming surfaces 120 and 120*a*, for purposes of illustration, are shown in FIG. 11 as disposed between adjacent yoke-forming surfaces and leg-forming surfaces. It should be noted that the core leg-forming surfaces may alternatively be on the exterior of the base portion, and the core yoke forming surfaces may be on the exterior of the leg portions if desired in a particular application. The preferred forming assembly 110 also includes a pair of side spacer plates 122, the purpose of which is explained below.

Figure 12:
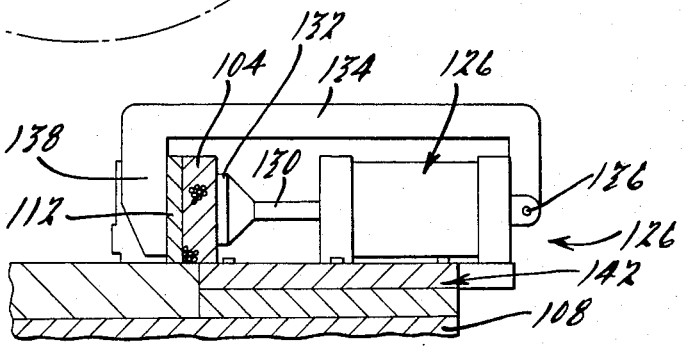
FIG. 12 is a sectional view taken along line 12—12 of FIG. 10.

Referring back to FIGS. 8 through 10, the preferred forming apparatus 102 includes a pair of first force-applying assemblies 126 which may include any of a number of actuator mechanisms known to those skilled in the art, such as a hydraulic cylinder, a pneumatic cylinder, or an electric solenoid, for example. Each of the first force-applying assemblies 126, which are illustrated in FIG. 12, includes a first extendible member 130 for forcibly urging a first die plate 132 against portions of the magnetic material 104. An anchor arm 134 is pivotally attached to a clevis 136 on each of the first force-applying assemblies 126. The anchor arms 134 have anchor hooks 138 on their opposite ends which may be pivoted into engagement with the end plug members 112 in order to fix the position of end plug members relative to the first force-applying assemblies 126. The first force-applying assemblies 126 are preferably slidably mounted in a guide assembly 142 on the platform 108 for purposes which will become apparent in connection with the discussion below of the operation of the preferred forming apparatus.

A pair of second force-applying assemblies 128 are secured to the platform 108 in the preferred embodiment of the forming apparatus. Each of the second force-applying assemblies 128, which may also include any of a number of known force actuators, includes a second extendible member 146 for forcibly uging a second die plate 148 against portions of the magnetic material 104.

In the operation of the preferred forming apparatus 102, the magnetic material 104 is pre-formed into a generally toroidal configuration and positioned in the forming apparatus as shown in FIG. 8. The end plug or forming members 112 are inserted into the central opening 106 with their inner edges 150 in a mutually abutting and interlocking relationship as is further explained below in connection with FIG. 11. The anchor arms 134 on the first force-applying assemblies 126 are pivoted inwardly such that the anchor hooks 138 engage the interior portions of bases of the end forming members 112. The anchor arms may be restrained from further pivotal movement by a locking means (not shown) if necessary.

Figure 9:
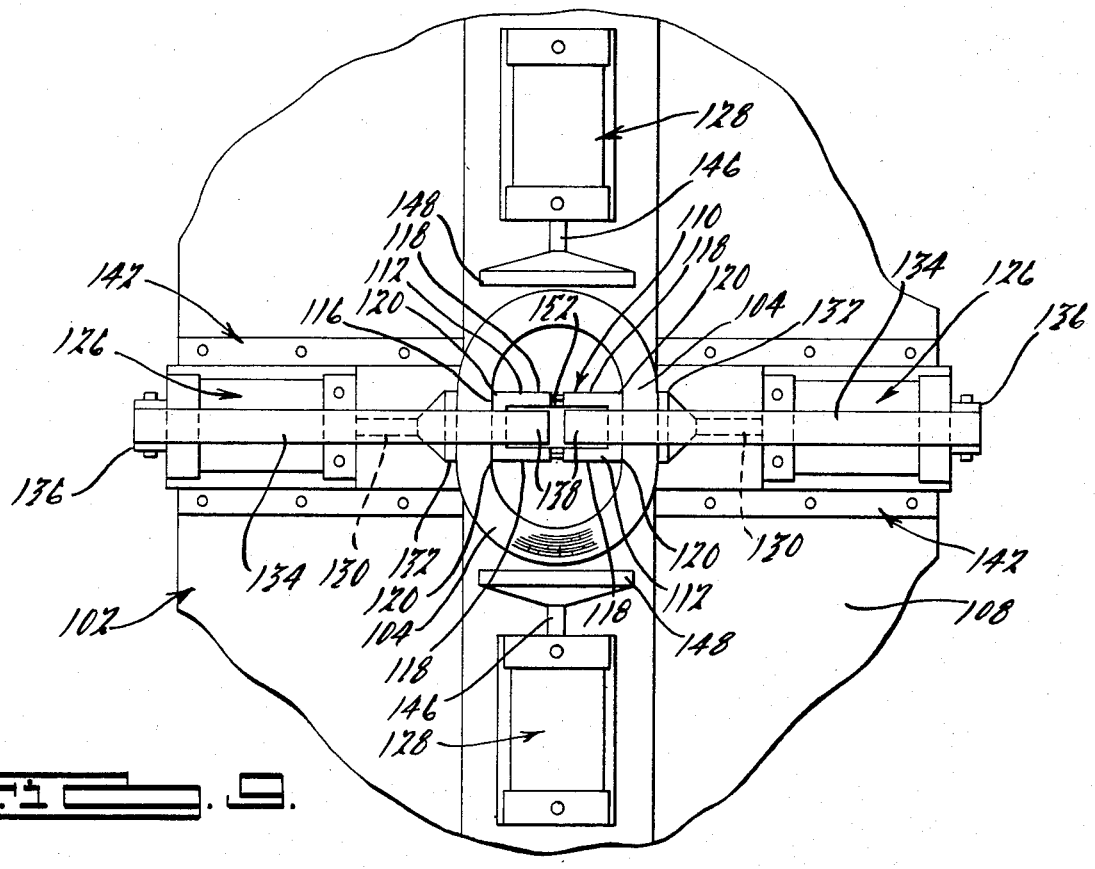
FIG. 9 is a plan view similar to FIG. 8, illustrating an intermediate point in the forming operation.

Once the forming apparatus 102 is set-up as shown in FIG. 8, the first force-applying assemblies are actuated, and first extendible members 130 extend outwardly to forcibly urge the first die plates 132 against the magnetic material 104. The force of the die plates 132 deforms and compresses opposite portions of the magnetic material 104 against the yoke-forming surfaces 116, as shown in FIG. 9, thereby forming the yoke portions of the magnetic core. The deformation and compression of the yoke portions may also cause the remainder of the magnetic material to bulge outwardly somewhat as is also shown in FIG. 9. Once such deformation and compression is completed, the first force-applying assemblies remain energized in order to maintain the yoke portions in a deformed and compressed condition and to securely anchor the yoke portions against the yoke-forming surface 116.

Although the second force-applying assemblies 128 may in some cases be energized generally simultaneously with the first force-applying assemblies 126, it is preferable to complete the forming of the yoke portions of the core prior to forming the leg portions of the core, especially when forming a wound magnetic core as described having discrete lamination strips with cut joint ends.

Figure 10:
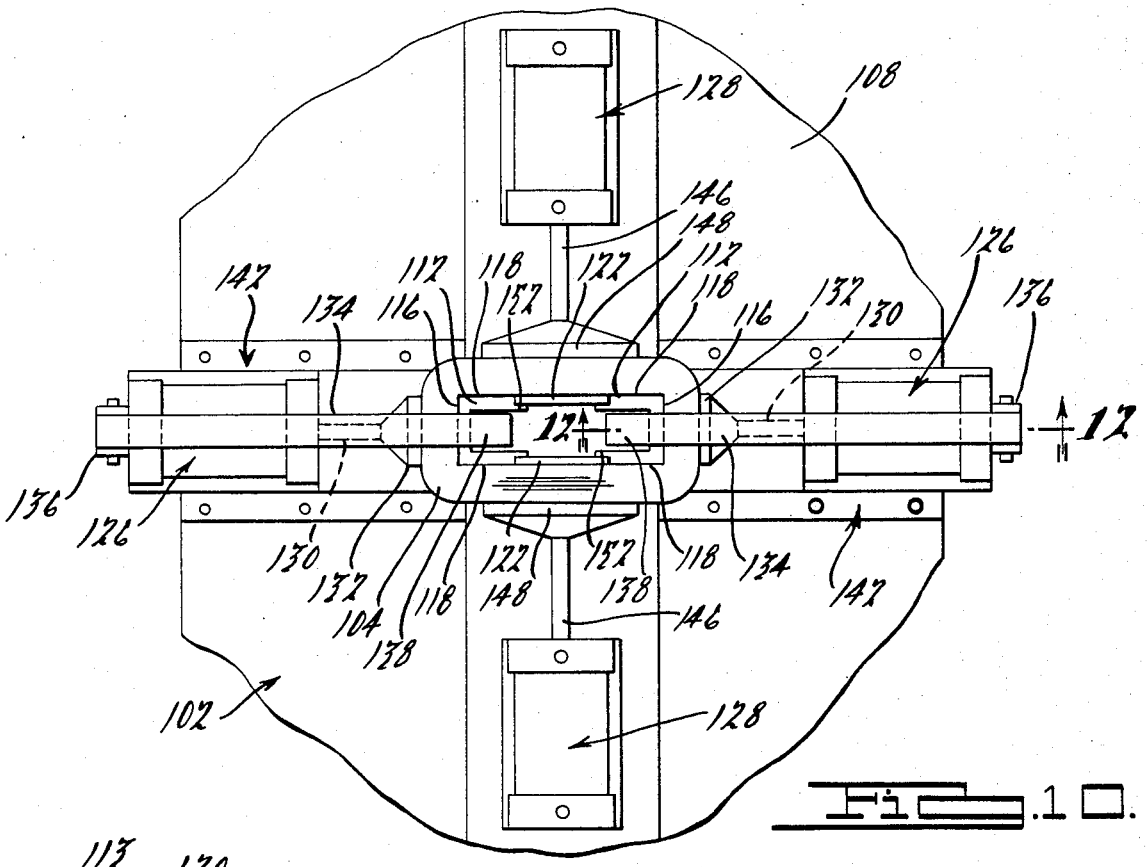
FIG. 10 is a plan view similar to FIGS. 8 and 9, illustrating the formed magnetic core.

When the second force-applying assemblies 128 are energized, the second extendible members 146 extend outwardly to cause the second die plates 148 to forcibly deform and compress the outwardly-bulging portions of the magnetic material against the leg-forming surfaces 118 as shown in FIG. 10. Such deformation and compression forms the leg portions of the magnetic core and simultaneously forcibly urges the magnetic material against the relatively precisely-formed corner-forming surfaces 120 in order to form the window opening and window corners to a predetermined shape and configuration with a very high degree of precision. Such ability to relatively precisely shape the core window opening and its corners allows the core to be fabricated with any of the above-described corner curvatures to derive the improved core performance and other advantages discussed above.

After the deforming and compressing steps are completed, the side spacer plates 122 are inserted between the ends 150 of the end plugs 112 in order to maintain the magnetic material in its formed shape during annealing. Consequently, the end plug assembly 122 is composed of suitable materials and structured such that it can be subjected to annealing temperatures along with the core. If necessary, the core may be further restrained by a perimeter banding strap (not shown). It should also be noted that the side spacer plates also prevent the core legs from sagging if the core is annealed in an orientation such that the window axis is horizontal.

Referring once again to FIG. 11, the outer ends 150 of the end plug or forming members 112 are fabricated with side plate shoulders 152 protruding therefrom. Such shoulders 152 are spaced from the formed leg portion of the core such that the side spacer plates 122 may be slid into place between the shoulders 152 and the core legs as shown in FIG. 10. The shoulders 152 also keep the side spacer plates in place by restraining them from inward movement toward the core window opening.

Each of the shoulders 152 on the plug ends 150 also includes locking recess 154 and a locking tab 156 protruding therefrom. The locking tabs and recesses are sized and positioned such that the tabs on one end forming member are interlockingly received within the recesses on the other end forming member in order to keep the plugs in a properly aligned, mutually abutting relationship when the first force-applying assemblies 126 are energized or actuated. Such interlocking relationship prevents side-to-side relative movement of the end forming members as well as relative tilting or rotation during the first forming operation, but does not, however, prevent or impede the end forming members from separating properly during the second forming operation as described above.

Also, preferably the forming plugs are sized, and the orientation and relationship of the locking recesses 154 and tabs 156, as shown in FIG. 11, are particularly located such that they may be interlocked only when the forming plugs are in a predetermined relationship. Thus, for example, where differing corner configurations are desired at the plug corners such as 120 and 120*a*, shown for example in FIG. 11, and the more gradually curved corners of the finished core are to be adjacent to a particular leg of the core, the two forming plugs cannot be interlocked unless the two plugs are properly oriented so that the locking tabs 156 on one plug are aligned with the corresponding locking recesses 154 on the other plug. Consequently, if one of the plugs is inverted, for example, or otherwise improperly oriented, the locking tabs and recesses cannot be interlocked and thus create excessive space between the shoulders 152 so that the two plugs will not fit into the central opening 106 in the unformed toroid shown in FIG. 8. This prevents the forming plugs from being installed into the unformed core toroid unless the plug corners are oriented on their proper sides. For example, if the desired core window configuration is to have a pair of more gradually curved corners adjacent a particular leg portion of the core, such as shown in FIGS. 2 through 5, the forming plugs must have a corresponding pair of gradually curved corners located on the same side of the forming plug assembly, and the assembly must be oriented so that this pair of more gradually curved corners is located adjacent the proper portion of the unformed magnetic material, as shown for purposes of illustration in FIG. 8. The preferred forming plugs are therefore properly dimensioned and configured such that if the forming plugs are improperly installed with their more gradually curved corners positioned on diagonally opposite sides of the core window, the surfaces 150, 152, 154, and 156 will not nest together and the properly dimensioned set of forming plugs cannot be installed into the round, unformed toroidal window of the core material.

As discussed above, the forming plugs are preferably configured and dimensioned or sized such that the forming plug assembly is too large to fit into the central opening of the unformed magnetic material if one of the end plugs is installed improperly in an inverted position, for example. In order to achieve such a relationship, the preferred forming plug assembly should be configured and dimensioned to fit into the central opening of the unformed magnetic material with a very small clearance. An acceptable amount of such clearance has been found, in actual preliminary prototype developmemt and testing work, to be on the order of approximately 0.10 inch, measured along a diagonal from one corner to the diagonally opposite corner of a properly mated and installed forming plug assembly. The exact clearance for a particular core design and configuration is readily determinable by one skilled in the art and is based upon factors such as the desired dimensions of the finished core window, the size of the central opening of the unformed magnetic material, the degree and shape of curvature of the forming plug corners, and the length, width and other dimensions of other various portions of the forming plugs, for example.

In addition to guarding against improper installation of the forming plugs, the above-described relationship and small clearance between the properly installed preferred forming plug assembly and the unformed magnetic material may also be used to properly position the preferred forming plug assembly in the central opening of the unformed magnetic material. For example, where the desired core window configuration is to have a pair of more gradually curved corners adjacent a particular leg portion of the core, such as shown in FIGS. 2 through 5, the forming plugs must have a pair of corresponding gradually curved corners located on the same side of the forming plug assembly, and the assembly must be oriented so that this pair of more gradually curved corners is located adjacent the proper portion of the unformed magnetic material as shown for purposes of illustration in FIG. 8. Accordingly, because of such pair of more gradually curved corners, the length of the perimeter surface of the properly mated preferred forming plug assembly is unequal or asymmetrical on opposite sides of a centerline lying substantially equidistant between, but parallel to, the leg portions 114 of the forming plugs. Such perimeter surface length is thus shorter on the side of the assembly having the more gradually curved corners 120*a* than on the side of the less gradually curved corners 120, as shown for example in FIG. 11.

Because of the above-described asymmetry of the forming plug assembly in the present example, the forming plug assembly should be properly located in the central opening of the unformed magnetic material so that the proper amount of magnetic material will be available to conform to the unequal or asymmetrical perimeter surface of the forming plug assembly. To be so properly located, the above-mentioned centerline of the forming plug assembly must be offset from the centerline of the central opening of the unformed magnetic material in a direction toward the portion of the magnetic material that when formed will become the portion of the core having the more gradually curved window corners and thus a shorter core length. Such offset is shown for purposes of illustration in FIG. 8 wherein the centerline of the central opening 106 is indicated by reference numberal 172, and the centerline of the forming plug assembly is indicated by reference numeral 174. The required amount of such offset is automatically achieved with the preferred forming plug assembly as a result of the above-discussed dimensioning or sizing of the properly mated and installed forming plug assembly having the above-discussed small clearance within the central opening of the magnetic material. Thus, when the core is formed as described above, the magnetic material is deformed in the proper relationship and at the proper locations to avoid excessive stretching or buckling of opposite sides of the core which would otherwise be likely to result from the asymmetric perimeter surface length of the forming plug assembly. It should also be noted that the above-described dimensioning and configuring of the forming plug assembly may also be employed in the alternate forming apparatus of FIGS. 13 through 16.

Figure 13:
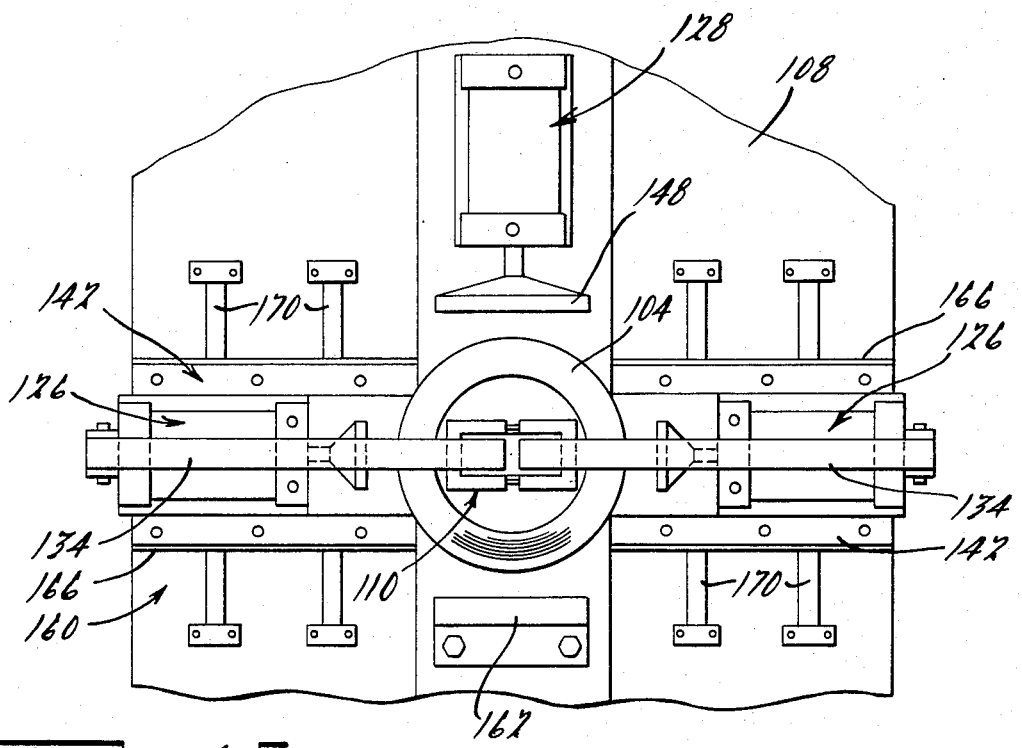
FIG. 13 is a plan view similar to FIG. 8, but illustrating an alternate embodiment of a forming apparatus according to the present invention.

In FIG. 13, an alternate embodiment 160 of the forming apparatus is illustrated and includes a fixed die plate 162 substituted for one of the second force-applying assemblies 128 of the preferred embodiment discussed above. In the forming apparatus 160, the first force-applying assemblies 126 are slidably mounted in their guide assemblies 142 which are in turn fixed to a carriage member 166. The carriage member 166 is slidably movable on guide members 170 in a direction generally perpendicular to the direction of slidable movement of the first force-applying assemblies 126 relative to the guide assembly 142. In other respects the forming apparatus 160 is similar to the forming apparatus 102.

After the yoke-portions of the core have been formed, the second force-applying assembly 128 is energized or actuated, and the second die plate 148 acts in conjunction with the fixed die plate 162 to deform and compress the magnetic material to form the core leg portions. During such deformation and compression, the magnetic material is displaced and moves toward the fixed die plate 162, and simultaneously the slidably moveable carriage member 166 moves both of the first force-applying assemblies in a parallel direction along with the magnetic material. Thus the first force-applying assemblies 126 are capable of movement in two generally perpendicular directions in order to precisely form the desired window opening and window corner shape and configuration.

Figure 14:
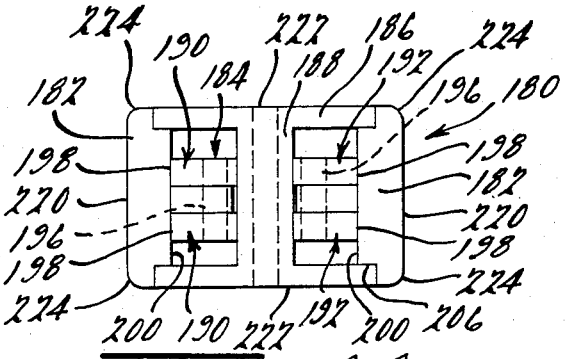
FIG. 14 is a plan view of an alternate assembly for forming the window and window corners of the magnetic core.
Figure 16:
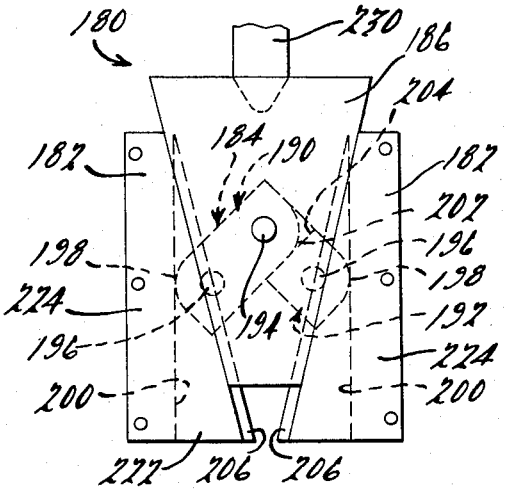
FIG. 16 is a side view similar to FIG. 14, with portions broken away and illustrating the assembly of FIG. 13 in an extended position.
Figure 15:
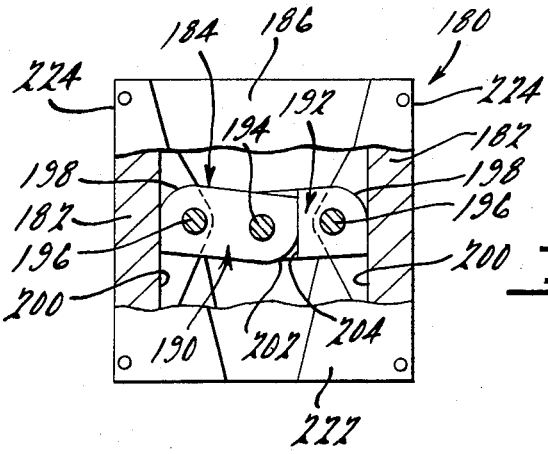
FIG. 15 is a side view of the assembly of FIG. 13, shown in a contracted position.

FIGS. 14 through 16 illustrate an alternate window forming assembly comprising a toggle plug assembly 180, which preferably includes a pair of end forming members 182 interconnected by a toggle mechanism 184. A pair of side plates 186 are carried by the toggle mechanism 184 and are interconnected by a relatively rigid bridge portion 188.

The toggle mechanism 184 includes a pair of first links 190 and a pair of second links 192 pivotally interconnected by a center pin 194. The center pin 194 also pivotally carries the pair of side plates 186 slidably received in tracks 206 on the sides of the end forming members. The first links 190 and the second links 192 are pivotally connected to their associated end forming members such that when the links are pivoted toward each other, the side plates 186 move outwardly in the tracks 206 and the end forming members 182 contract toward each other. Conversely, when the links are pivoted away from each other, the side plates move inwardly and the end forming members expand away from each other.

The end forming members have yoke-forming surfaces 220 on their outer ends and leg-forming surfaces 222 on their sides, with corner-forming surfaces 224 therebetween. As was discussed above in connection with the preferred forming assembly 110, the toggle plug assembly may also alternatively have the location of its yoke-forming surfaces and leg-forming reversed.

The toggle plug assembly is contracted and inserted into the central opening of a pre-formed, generally toroidal, quantity of magnetic material such as that illustrated in FIGS. 8 through 10 and 13. A force is exerted upon the bridge portion 188 by a force-applying apparatus illustrated schematically by member 230 in FIG. 16. The force may also be actuated by force-applying assemblies such as those discussed above in connection with FIGS. 8 through 13 or by a conventional press apparatus, for example.

When the force is applied to the rigid bridge portion 188, the end forming members are forcibly urged apart to deform the magnetic material in order to form the desired core window opening and window corner shape and configuration with a high degree of precision. Preferably, the toggle mechanism 184 is rotated slightly "over-center", past a position at which the centerlines of the links 190 and 192 are aligned, as shown in FIG. 15, when the end forming members are expanded. Such over-center position allows the links to serve as a spacer mechanism to resist the spring-back or reactive force of the magnetic material and thus preserve the formed core shape during annealing.

In order to prevent undesirable deformation of the center pin 194 and the end pins 196 when the core is annealed the pins are fit relatively loosely in the apertures in the links and end forming members, and the links 190 and 192 are provided with abutment surfaces 198 on their ends that engage bearing surfaces 200 on the end forming members. Similarly, the links 190 and 192 are also provided with mutally engageable abutment surfaces 202 and abutment shoulders 204 near the center pin 194. Since the pins are loosely fitted in their respective components, the spring-back or reactive force of the pre-annealed core is taken by the various abutment and bearing surfaces discussed above and not by the pins.

It should be noted that the toggle plug assembly may alternatively be equipped with a toggle mechanism that may be removed after other spacer means have been inserted prior to core annealing, thereby avoiding subjecting the toggle mechanism to annealing conditions. In such an embodiment, the toggle mechanism may even be incorporated into the above-described press or other force-applying apparatus. As still another alternate embodiment, the preferred or alternate toggle plug assemblies may be combined with external core-forming means such as the force-applying assemblies and die plate members discussed above.

The foregoing discussion discloses and describes several merely exemplary embodiments of the present invenion. One skilled in the art will readily recognize from such discussion that various changes, modifications, and variations may be made therein without departing from the spirit and scope of the invention as defined in the following claims.

What is claimed is:

1. In an electrical transformer having electrical conductor windings and a magnetic core, said magnetic core having a pair of spaced-apart yoke portions and a pair of spaced-apart leg portions, said yoke portions and said leg portions having inner surfaces defining a window opening for receiving at least a portion of said windings extending therethrough, a first of said leg portions forming a pair of first arcuate window opening corners at its intersections with said spaced-apart yoke portions, a second of said leg portions forming a pair of second arcuate window opening corners at its intersections with said spaced-apart yoke portions, extensions of the inner surfaces of said first leg portion and said yoke portions defining a pair of first excluded areas with said first arcuate window opening corners with said first excluded areas being generally adjacent opposite ends of the inner surface of said first leg portion, and extensions of the inner surfaces of said second leg portion defining a pair of second excluded areas with said second arcuate window opening corners with said second excluded areas being generally adjacent opposite ends of the inner surface of said second leg portion, the improvement wherein at least one of said first excluded areas is greater than at least one of said second excluded areas.

2. The improvement according to claim 1, wherein said magnetic core is comprised of a pair of magnetic cores, said electrical conductor windings extending through the window openings of said pair of magnetic cores and circumscribing said second leg portions of said magnetic cores.

3. The improvement according to claim 1 or 2, wherein the ratio of said one of said first excluded area to said one of said second excluded area is in the range of approximately twenty-five-to-one to approximately four-to-one.

4. The improvement according to claim 3, wherein the ratio of said one of said first excluded area to said one of said second excluded area is approximately nine-to-one.

5. The improvement according to claim 1, wherein said magnetic core is composed of a plurality of laminations of magnetic material, each of said laminations being formed from a cut strip of said magnetic material.

6. The improvement according to claim 1, wherein said magnetic core is composed of a plurality of laminations of magnetic material, each of said laminations being formed from a cut strip of said magnetic material, substantially all of the ends of said strips lying in said second leg portion.

7. In an electrical transformer having electrical conductor windings and a magnetic core, said magnetic core having spaced-apart leg portions intersecting with spaced-apart yoke portions, said leg portions and said yoke portions defining a window opening therein for receiving at least a portion of said windings extending therethrough, at least one of said yoke portions being spaced a predetermined keep-back distance from said portion of said windings extending through said window, the improvement wherein said keep-back distance between said at least one yoke portion and said portion of said windings increases from at least one of the intersections between said yoke portions and leg portions to a predetermined location between said leg portions, said keep-back distance being greatest at a location substantially midway between said leg portions.

8. The improvement according to claim 7, wherein said electrical conductor windings include a low voltage coil adjacent each of said leg portions of said core and a high voltage coil disposed between said low voltage coils, said keep-back distance being greatest at the location substantially adjacent said high voltage coil.

9. The improvement according to claim 7 or 8, wherein said increasing keep-back distance increases at a non-constant rate.

10. The improvement according to claim 7 or 8, wherein said keep-back distance decreases from said substantially midway location to the other of the intersections between said one yoke portion and said leg portions.

11. The improvement according to claim 10, wherein said decreasing keep-back distance decreases at a non-constant rate.

12. The improvement according to claim 11, wherein said increasing keep-back distance increases at a non-constant rate.

13. In an electrical transformer having electrical conductor windings and a magnetic core, said magnetic core having a window opening therein for receiving said windings therethrough, said window opening being defined by a pair of spaced-apart yoke portions and a pair of spaced-apart leg portions, a first of said leg portions forming a pair of first window corners at its intersections with said spaced-apart yoke portions, a second of said leg portions forming a pair of second window corners at its intersections with said spaced-apart yoke portions, the improvement wherein said first and second window corners are radiused, the radius of each of said first corners being greater than the radius of either one of said second corners.

14. The improvement according to claim 13, wherein said magnetic core is comprised of a pair of magnetic cores said electrical conductor windings extending through the windows of said pair of magnetic cores and circumscribing said second leg portions of said magnetic cores.

15. The improvement according to claim 13, or 14, wherein the ratio of the radius of said first corners to the radius of said second corners is in the range of approximately five-to-one to approximately two-to-one.

16. The improvement according to claim 15, wherein the ratio of the radius of said first corners to the radius of said second corners is approximately three-to-one.

17. The improvement according to claim 13, wherein said magnetic core is composed of a plurality of wound laminations of magnetic material, each of said laminations being formed from a discrete strip of said magnetic material.

18. The improvement according to claim 13, wherein said magnetic core is composed of a plurality of wound laminations of magnetic material, each of said laminations being formed from a discrete cut strip of said magnetic material, substantially all of the cut ends of said strips lying in said second leg portion.

19. The improvement according to claim 18, wherein the ratio of the radius of said first corners to the radius of said second corners is in the range of approximately five-to-one to approximately two-to-one.

20. The improvement according to claim 19, wherein the radius of each of said first corners is approximately 0.75 inch and the radius of each of said second corners is approximately 0.25 inch.

21. A magnetic core for an electrical device, said magnetic core comprising a pair of spaced-apart leg portions, a pair of spaced-apart yoke portions interconnecting said leg portions, said leg portions and said yoke portions defining a window opening extending axially through said core, a first of said leg portions forming a pair of radiused first corners of said window opening at the intersections of said first leg portion with said yoke portions, a second of said leg portions forming a pair of radiused second corners of said window opening at the intersections of said second leg portion with said yoke portions, the radius of either of said first corners being larger than the radius of either of said second corners.

22. A magnetic core according to claim 21, wherein said magnetic core is composed of a plurality of cut strips of magnetic material.

23. A magnetic core according to claim 21, wherein said magnetic core is composed of a plurality of cut strips of magnetic material, substantially all of the cut ends of said strips lying in said second leg portion between said second corners of said window opening.

24. A magnetic core according to claim 21 or 23, wherein the radius of each of said first corners is within the range of approximately two to approximately five times the radius of each of said second corners.

25. A magnetic core according to claim 24, wherein the radius of each of said first corners is approximately three times the radius of each of said second corners.

26. A magnetic core according to claim 25, wherein the radius of each of said first corners is approximately 0.75 inch and the radius of each of said second corners is approximately 0.25 inch.

* * * * *